US009905082B2

(12) United States Patent
Dengler et al.

(10) Patent No.: US 9,905,082 B2
(45) Date of Patent: Feb. 27, 2018

(54) SYSTEMS, METHODS, AND COMPUTER-READABLE MEDIA FOR DETERMINING AND SYNCHRONIZING LIVE EVENT INFORMATION

(71) Applicant: SportsMEDIA Technology Corporation, Durham, NC (US)

(72) Inventors: John D. Dengler, Durham, NC (US); Gerard J. Hall, Durham, NC (US)

(73) Assignee: SPORTSMEDIA TECHNOLOGY CORPORATION, Durham, NC (US)

( * ) Notice: Subject to any disclaimer, the term of this patent is extended or adjusted under 35 U.S.C. 154(b) by 73 days.

(21) Appl. No.: 15/065,652

(22) Filed: Mar. 9, 2016

(65) Prior Publication Data

US 2016/0267747 A1 Sep. 15, 2016

Related U.S. Application Data

(60) Provisional application No. 62/130,438, filed on Mar. 9, 2015.

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***G07F 17/32*** | (2006.01) |

(52) U.S. Cl.

CPC ..... *G07F 17/3288* (2013.01); *G07F 17/326* (2013.01); *G07F 17/3244* (2013.01)

(58) Field of Classification Search

CPC ..... G07F 17/3288

See application file for complete search history.

(56) References Cited

U.S. PATENT DOCUMENTS

| | | | |
|---|---|---|---|
| 7,534,169 | B2 | 5/2009 | Amaitis et al. |
| 8,029,362 | B2 | 10/2011 | Walker et al. |
| 8,057,300 | B2 | 11/2011 | Corbo |
| 8,734,231 | B2 | 5/2014 | Shore et al. |
| 9,138,638 | B2 | 9/2015 | Bastawros |
| 2002/0068633 | A1 | 6/2002 | Schlaifer |
| 2007/0082740 | A1 | 4/2007 | Stearns et al. |

(Continued)

OTHER PUBLICATIONS

International Search Report and Written Opinion for PCT/US2016/021611 dated May 17, 2016.

*Primary Examiner* — Kevin Y Kim

(74) *Attorney, Agent, or Firm* — Neo IP

(57) ABSTRACT

Systems and methods for monitoring live events are generally described. A live event management system may be configured to track in-play activities during a live event and to provide live event information to data consumers. The management system may be configured to provide an event timeline in real time or substantially real time that may facilitate reliable in-play wagering using accurate and up-to-date information. The event timeline may be used as a reference to review, manage, and monitor live events, wagers, and wager activity. The management system may be configured as an "end-to-end" wagering solution capable of, among other things, receiving wagers (or "bets") from bettors, managing and processing event information, and presenting wagers received from bettors to bookmakers.

20 Claims, 3 Drawing Sheets

(56) References Cited

U.S. PATENT DOCUMENTS

| | | | | |
|---|---|---|---|---|
| 2009/0149233 | A1* | 6/2009 | Strause | G06Q 50/34 463/7 |
| 2010/0321499 | A1 | 12/2010 | Ortiz et al. | |
| 2013/0136818 | A1 | 5/2013 | Uehara et al. | |
| 2013/0157735 | A1 | 6/2013 | Amaitis et al. | |
| 2014/0094274 | A1 | 4/2014 | Guinn et al. | |
| 2014/0274264 | A1 | 9/2014 | Fine et al. | |
| 2014/0274321 | A1* | 9/2014 | Ulrich | G07F 17/3244 463/25 |

* cited by examiner

SYSTEMS, METHODS, AND COMPUTER-READABLE MEDIA FOR DETERMINING AND SYNCHRONIZING LIVE EVENT INFORMATION

CROSS REFERENCE TO RELATED APPLICATIONS

This application claims the benefit of U.S. Provisional Application No. 62/130,438 filed on Mar. 9, 2015, the contents of which are incorporated by reference in their entirety as if fully set forth herein.

BACKGROUND

Wagering on live events, such as sporting events, has traditionally involved bettors wagering on the outcome of a sporting event with a sports book (or "bookmaker"), with the outcome being balanced by odds or a spread or line. In addition, bettors may make "side bets" or "side wagers" involving various aspects of the sporting event, depending on the particular sport. For instance, a popular side wager in football and basketball is an "over/under" wager in which an individual bets on whether the total score in a game will be over or under a certain value set by the sports book. Accordingly, whether a bettor has won or lost a wager is conventionally determined after the sporting event has concluded. In contrast, in-play wagering involves wagering on events that occur within an active sporting event. For example, in a golf tournament, a bettor could wager on the drive distance of a participant; in a football game, a bettor could wager whether the next play will be a run play or a pass play; and in a downhill ski race, a bettor could wager on the split times for a participant along the course.

Conventional technology does not generally provide enough information about an active sporting event to allow for reliable in-play wagering. For instance, sporting event information is traditionally not recorded in chronological order in relation to the play-by-play (or "scoring") data within the sporting event. Accordingly, sporting event information concerning particular players, for example, is not segmented into activities that are specific to each play occurring within a sporting event. Without such segmented information, bettors are not able to reliably wager on sporting event outcomes of each individual play (i.e., because the result of a previously play may affect the odds of subsequent plays).

In addition, bettors and sports books alike do not have access to sufficient broadcast images of the sporting event to have an adequate degree of certainty as to the outcome of in-play events. For example, in many sporting events, certain activities may not be recorded and/or broadcast, particularly in real time or substantially real time. In addition, recorded and/or broadcasted activities may not be presented in true chronological order. The live television presentation of a golf tournament, for instance, may not be chronologically accurate. For instance, a television producer, for the purpose of trying to create a compelling storyline or to present the most captivating action in the most efficient way possible, may editorialize and present recently "taped" segments out of true chronological order without making the distinction between live and recently taped known to viewers. This lack of chronological video broadcasts may be problematic for bookmakers as live data about a sporting event may be collected and relayed by bettors via computing devices, such as a smartphone device, back to sports books to place a wager.

Consequently, what is needed is a technological solution supporting real time live event data and video feeds in true chronological order to increase the reliability and integrity of in-play wagering for both bettors and bookmakers.

BRIEF DESCRIPTION OF THE DRAWINGS

The above and other objects of the present invention will become more readily apparent from the following detailed description taken in connection with the accompanying drawings.

SUMMARY

Figure 1:
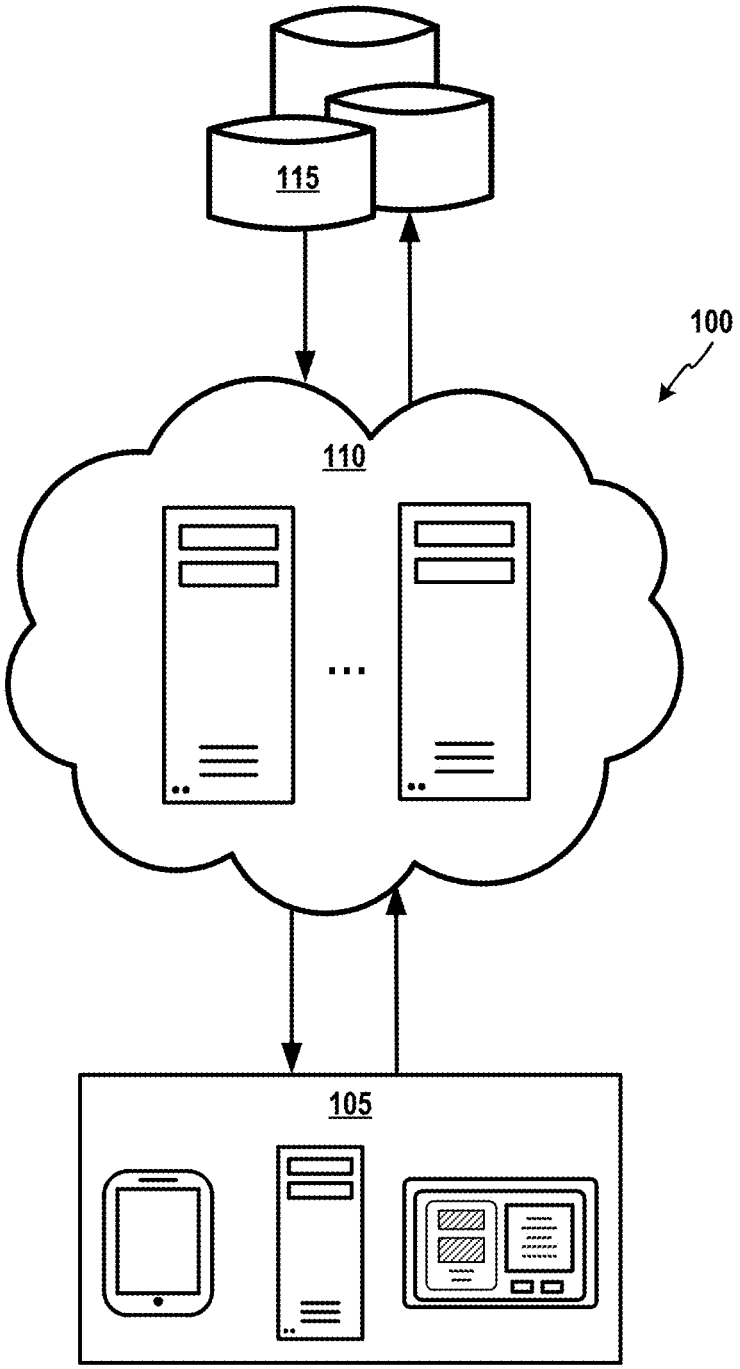
FIG. 1 depicts an illustrative in-play management system according to some embodiments.

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an embodiment, a live event management system may include a processor and a non-transitory, computer-readable storage medium in operable communication with the processor. The computer-readable storage medium may include one or more programming instructions that, when executed, cause the processor to receive live event information for a live event from at least one data source, generate at least one event timeline based on the live event information, the event timeline being configured to present at least one unit within the live event information in a chronological order, generate at least one in-play opportunity for the live event based on the at least one event timeline, gate wagering activity for the at least one in-play opportunity based on the live event information, receive at least one wager from a client computing device for the at least one in-play opportunity, and determine at least one wagering outcome of the in-play opportunity based on the live event information.

In an embodiment, a computer-implemented method for managing live event information may include, by a processor, receiving live event information for a live event from at least one data source, generating at least one event timeline based on the live event information, the event timeline being configured to present at least one unit within the live event information in a chronological order, generating at least one in-play opportunity for the live event based on the at least one event timeline, gating wagering activity for the at least one in-play opportunity based on the live event information, receiving at least one wager from a client computing device for the at least one in-play opportunity, and determining at least one wagering outcome of the in-play opportunity based on the live event information.

In an embodiment, an illustrative method for sports wagering may include a sport-specific aggregation operation for calculating and recording scoring and performance-related events and results, a wagering operation for managing and recording wagering events and results, and a video operation for recording video streams from one or more cameras which are capturing activity of a sports competition. In some embodiments, all events, activities, units, and/or the like may be recorded chronologically on a same event timeline, the event timeline being synchronized in time with each of the recorded video streams, and wagering events and results are presented and managed by using a combination of the recorded video streams and information provided by the aggregation method.

In various aspects, the event timeline may be automatically synchronized, in real time, to each of the recorded video streams, in a frame-accurate manner. In some embodiments, each camera may be simultaneously capturing a different view or area of activity involved within the sports competition. In some embodiments, a plurality of users may each place individual wagers on an outcome of at least a subset of scoring and performance-related events. In various aspects, a plurality of users may be automatically presented with a plurality of available wagers based on information provided by the sport-specific aggregation method and/or the wagering method configured according to some embodiments. In various aspects, a plurality of users is automatically presented with the odds for each available wager and the odds for each available wager are calculated using information provided by the sport-specific aggregation operation and/or the wagering operation configured according to some embodiments. In some embodiments, each individual wager is only allowed to be placed prior to the actual time at which the corresponding scoring or performance-related scoring event occurs.

In some embodiments, a time interval for the allowance of a particular wager may be determined based on information provided by the sport-specific aggregation operation, and that time interval is used by the wagering operation to limit the ability of an individual user to place that particular wager. In various aspects, the time interval may be determined dynamically based on the context of the sports competition, and the time interval may vary during the sports competition.

In some embodiments, the results of each individual wager may be reported to each user within a short time interval after a completion of the scoring or performance-related event. In various aspects, the wagering operation may log the wagering activity of each individual user in such a manner that wagering activity of each individual user may be reviewed either in real time or after a live event, such as a sports competition, is complete. In some embodiments, the wagering activity of each individual user may be reviewed simultaneously with any or all of the recorded video streams in a synchronous fashion.

In some embodiments, the wagering operation may include disabling any offered wager. Disablement of an offered wager implies that no user may place that wager. In various aspects, disablement may be performed manually. The decision process to disable any offered wager may include reviewing the event timeline and recorded video streams simultaneously and in a synchronous fashion. In various aspects, disablement may be performed automatically based on information provided by the sport-specific aggregation operation and/or the wagering operation.

In some embodiments, the wagering operation may include enabling an offered wager. In some embodiments, enablement of an offered wager implies that every user may place that wager. In various aspects, enablement may be performed manually. The decision process to enable an offered wager may include reviewing the event timeline and recorded video streams simultaneously and in a synchronous fashion. In various aspects, enablement may be performed automatically based on information provided by the sport-specific aggregation operation and/or the wagering operation.

In some embodiments, the wagering operation may include cancelling an individual user's wager, even after the corresponding scoring or performance-related event has occurred. In some embodiments, cancelling a user's wager implies that the user may neither collect winnings nor lose money based on the outcome of that wager. In some embodiments, the decision to cancel an individual user's wager may include reviewing the event timeline and recorded video streams simultaneously and in a synchronous fashion.

In some embodiments, the scoring and performance-related events and results may include events and results based on spatial tracking of objects. In some embodiments, the objects may include, without limitation, a player, a ball, a playing surface, an official, a referee, and/or an umpire. In some embodiments, the scoring and performance-related events and results may include official clock events. In some embodiments, the scoring and performance-related events and results may include official scoring events and results that are manually input by a user. A manually entered event timestamp may be synchronized to the recorded video streams such that any delay in the manual entry is not reflected in the timeline. In some embodiments, the scoring and performance-related events and results may include official scoring events and results that are automatically determined by the sport-specific aggregation operation.

In some embodiments, the scoring and performance-related events and results may include events and results based on tracking biometric data of players. In some embodiments, the biometric data may include, without limitation, a heart rate or a blood pressure.

DETAILED DESCRIPTION

The described technology generally relates to systems for monitoring live events. In some embodiments, a live event management system ("management system" or "system") may be configured to track in-play activities during a live event and to provide live event information to data consumers. In some embodiments, the described technology may be used for in-play live event wagering. In particular, the management system may be configured according to some embodiments to manage, synchronize, and present various forms of live event information to provide bettors and bookmakers with a reliable system for in-play wagers on live events. In some embodiments, the management system may be configured to aggregate, synchronize, and/or segment the various forms of live event information. In some embodiments, the management system may be configured to provide an event timeline in real time or substantially real time that may facilitate reliable in-play wagering using accurate and up-to-date information. In some embodiments, the event timeline may be used as a reference to review, manage, and monitor live events, wagers, and wager activity. In some embodiments, the management system may be an "end-to-end" wagering solution capable of, among other things, receiving wagers (or "bets") from bettors, managing and processing event information, and presenting wagers received from bettors to bookmakers.

A live event refers to an event occurring in real time which has not concluded in its entirety. Non-limiting examples of live events may include sporting events, elections, award ceremonies, weather conditions, games of chance, or the like. Illustrative sporting events may include, without limitation, a baseball game, a football game, a hockey game, a basketball game, a tennis match, a soccer match, a volleyball match, a cricket match, a rugby match, a lacrosse game, a race (for instance, a motor vehicle race, a bicycle race, a ski race, or a speed skating race), a track and field competition, a fighting match (for example, a boxing or a mixed martial arts match), and a fishing tournament.

For purposes of clarity, the systems and methods described herein are generally described with respect to a sporting event, such as a football game. However, those having ordinary skill in the art will recognize that the systems and methods are applicable to all live events, regardless of the type of event. In addition, although the management system may be described as relating to wagering, embodiments are not so limited, as the management system may be configured to monitor and provide live event information for other purposes.

Live event information refers to any type of information associated with a live event, including, without limitation, event media content, participant information, context information, and in-play opportunities. Event media content refers to any type of media recorded, broadcast, or otherwise created from the event. The media may include various forms of media alone or in combination, including video, audio, and textual media. For example, event media content may include a broadcast television feed of a golf tournament. In another example, event media content may include a plurality of camera feeds for a football game presented through the management system. In some embodiments, the event media content may include video content annotated with text, images, or the like. In some embodiments, the event media content may include social media content. In some embodiments, the event media content may be presented and/or consumed in real time or in substantially real time.

Participant information refers to information associated with participants of the event. For instance, for a sporting event, participants may include teams, players, and/or coaches. The participation information may relate to the actions, statistics, results, or the like associated with the live event participants. In some embodiments, the live event information may include media source information associated with the source of the media content including, without limitation, media equipment information, timestamp information, location information, media subjects (for example, participants recorded on the media), or the like. In some embodiments, the media source information may be embedded in and/or combined with the media content.

The participant information may generally include scores, plays, player and/or team live and historical statistics, object location and motion information, player location and motion information, player physiological information, biometric information, injury information, official clock events, and historical information.

Context information may generally refer to any information capable of providing context to the live event, such as the live event participants or the live event information. Illustrative context information may include weather conditions and/or forecasts, player injury information, event location (for instance, indicating home and away teams), bookmaker odds and/or spreads, off-the-field information that may affect the live event and/or participants, or the like.

In-play opportunities may generally refer to opportunities for wagering within a live event. The in-play opportunities may be specific for each type of live event. For instance, for a football game, in-play opportunities may include play selection, yards-from-scrimmage for a particular play, or the like. In a basketball game, an in-play opportunity may include the number of free throws a player will make. In some embodiments, the in-play opportunities may be dynamically generated by the system based on the particular situation of the game and, accordingly, may change as the game situation changes.

Wagering information may generally refer to any information associated with a wager placed by a bettor. Non-limiting examples of wagering information may include a live event, wager amount, time of wager, bettor information (for instance, name and address information, demographic information, account information, preference information, and historical information), bookmaker information (for example, business information and address information), in-play opportunity (for example, a wagering opportunity within a live event), payment information, odds, and a spread or line. The wagering information may include information used by a bettor to place a wager and/or information used by a bookmaker to receive, pay-out, or otherwise process a wager by a bettor.

FIG. 1 depicts an illustrative management system according to some embodiments. As shown in FIG. 1, the management system 100 may include one or more server logic devices 110, which may generally include a processor, a non-transitory memory or other storage device for housing programming instructions, data or information regarding one or more applications, and other hardware, including, for example, the central processing unit (CPU) 305, read only memory (ROM) 310, random access memory (RAM) 315, communication ports 340, controller 320, and/or memory device 325 depicted in FIG. 3 and described below in reference thereto.

In some embodiments, the programming instructions may include an in-play live event management application (the "management application" or the "application") configured to, among other things, manage and present live event information, wagering information, in-play opportunities, and/or combinations thereof. The server logic devices 110 may be in operable communication with client logic devices 105, including, but not limited to, server computing devices, personal computers (PCs), kiosk computing devices, mobile computing devices, laptop computers, smartphones, personal digital assistants (PDAs), global positioning system (GPS) devices, televisions (i.e., "smart" televisions), printing devices, tablet computing devices, in-car entertainment (ICE) systems, any other logic and/or computing devices, and/or content presentation devices.

In some embodiments, the management application may be accessible through various platforms, such as a client application, web-based application, over the Internet, and/or a mobile application (for example, a "mobile app" or "app"). According to some embodiments, the management application may be configured to operate on each client logic device 105 and/or to operate on a server computing device accessible to client logic devices over a network, such as the Internet. All or some of the files, data and/or processes used by the management application may be stored locally on each client logic device 105 and/or stored in a central location and accessible over a network (e.g., the Internet or on server logic devices 110). In some embodiments, bettors and/or bookmakers may interact with the management application and/or each other through the client logic devices 105.

In some embodiments, users may input various preferences through a mobile app, such as favorite teams, favorite sports, favorite in-play opportunities, betting preferences, or the like. In some embodiments, the management system 100 may be configured to obtain user information through accounts required for users to use a client logic device 105, for instance, through a mobile app, to access and use the management system. In some embodiments, a user may watch or otherwise access a live event through the management system. For instance, a user may view a sporting event via a video feed presented through the management system 100 platform.

The management application may be configured to receive event information from various data sources 115 relating to various live events, for example, simultaneously and in real time or substantially in real time. The management application may operate to generate an event timeline by processing the event information in chronological order, for example, in relation to the "scoring," activity, and/or "play-by-play" timeline of the live event. In some embodiments, the management application may generate one or more separate timelines for the various forms of event information. Non-limiting examples of event timelines may include team event timelines, player event timelines, game event timelines, context timelines, media content timelines, or the like. In some embodiments, an event timeline may include at least one graphical user interface ("GUI") object that may be presented on a display of a client computing device.

The data sources 115 may include media content sources, such as, without limitation, broadcast media, streaming media, camera feeds, media accessed over a network, and/or the like. In some embodiments, the media content sources may be configured to provide all or substantially all of the relevant action from a live event. In some embodiments, the management application may be configured to analyze the media content to determine actions, participants, or the like that are included in the media content. For instance, the management application may be configured to determine which teams are playing and/or a particular action (for example, a golf shot in a golf tournament or a field goal attempt in a football game) in a live event based on content recognition techniques. In some embodiments, the management application may be configured to analyze the media content based on the event information to determine whether any live event action is not available and/or has occurred. For example, for a golf tournament, the management application may determine that Player A has taken 40 strokes based on the event information, but the media content only recorded 39 strokes. Accordingly, the management system 100 may inform the bookmaker that the media content is missing 1 stroke for Player A. In another example, the management application may have generated a field goal in-play opportunity and may analyze the real time or substantially real time media content to determine whether the field goal attempt has occurred.

In some embodiments, the management application may segment or generate "chunks" of the event information that are specific to one or more units (or "actions," "plays," and/or the like) within the live event. In some embodiments, the event timeline may include the segments. For example, a unit may be a play in a football game or a stroke in a golf tournament or any other divisible element or action of a live event. Accordingly, the management application may segment the event information, such as the participant information, for a football game for each play within the game. In this manner, a bettor may wager on in-play opportunities based on outcomes of each individual unit (or play). In some embodiments, the units may be grouped, sub-grouped, and/or aggregated. For example, in a baseball game, individual pitch units may be aggregated by inning and/or by batter; in a football game, plays may be aggregated according to drives by each team (offensive or defensive); in a golf tournament, strokes may be grouped by round, hole, location, context, player, nationality, distance, club, handedness, or the like. For instance, in a round of golf, there may be an average of 72 wagering opportunities (strokes) for each golfer during each round.

In some embodiments, the event information for a live event may be synchronized with the media content for the live event. In some embodiments, the event information may be synchronized with the media content, such as video content, in a frame-accurate manner. For instance, the participant information for a football game may be synchronized with the actual media content (i.e., video footage) of the game to generate information-synchronized media content. Accordingly, a bookmaker using the management application may verify wager outcomes (for instance, the drive distance of Player A from the $8^{th}$ tee in a golf tournament) by viewing the action as provided in the media content in relation to the participant information for the action, which may be achieved, for example, by viewing the information-synchronized media content.

In some embodiments, the management application may be configured to generate in-play wagering opportunities (or "in-play opportunities"). The in-play opportunities may include in-play information configured to define the in-play opportunities, such as, without limitation, a participant, an action, a unit, odds, enabled/disabled bettors, and a spread or line. For instance, a football game in-play opportunity may include a team and a play selection (for example, run or pass), a receiver route (for example, an out pattern, a post route, or the like), where a player will line up on the line of scrimmage for a particular play, or the like. In another instance, a baseball game in-play opportunity may include an at-bat unit for a player and the outcome of the at bat (for example, hit, strike out, walk, hit by pitch, on-base by wild pitch, on-base by passed ball, or the like). In some embodiments, certain in-play opportunities for sporting events may be standard based on the sport. In some embodiments, in-play opportunities may be generated dynamically based on the event information. For example, in a football game, an in-play opportunity concerning whether a running back will rush for more than 100 yards may be generated responsive to the player rushing for 80 yards. In another example, in a baseball game live event, an in-play opportunity of whether a player will pitch a no-hitter may be enabled once the player has pitched seven innings without giving up a hit. In addition, the in-play information may be modified based on the event information. For instance, for the no-hitter in-play opportunity example, the odds associated with the in-play opportunity may change based on the inning, the hitter, the number of pitches thrown, or the like.

In view of the dynamic and time-based nature of live events, the management application may be configured to "gate" the wagering activity associated with an in-play opportunity by specifying time intervals between which wagers are allowed and/or specifying when wagering will open (i.e., "opening gate") and will close (i.e., "closing gate"). In some embodiments, an in-play opportunity gate may be established based on the event information, such as the real time receipt of scoring and performance events by the management application. In some embodiments, gates may be based on standard intervals that occur in each particular sport, such as the time lapse between a golfer's shots, time between batters for a baseball pitcher, time between plays for a football team, or the like. In some embodiments, the management application may prevent bettors from wagering on in-play opportunities outside of the gates. In this manner, reliable and predictable wagering windows may be presented to a bettor, and the bookmaker can ensure that wagers are not made after an action has occurred.

In some embodiments, the data sources 115 may include external information that is not obtained from the live event. Illustrative and non-restrictive examples of external information sources may include information from social networks (for example, Facebook®), content feeds (for example, Twitter®), content services (for example, Instagram™), news sources, crowd sourcing sites, polls, odds information sources, third party databases (for example, historical information such as information from the Elias Sports Bureau), or the like. In some embodiments, the management application may use the external information sources to generate the in-play opportunities, the opportunity information, gates, or the like. For instance, the odds associated with an in-play opportunity may be modified based on crowd sourcing information, social media posts, and/or polling results. In some embodiments, the management application may include information from the external information source in the event timeline.

Figure 2:
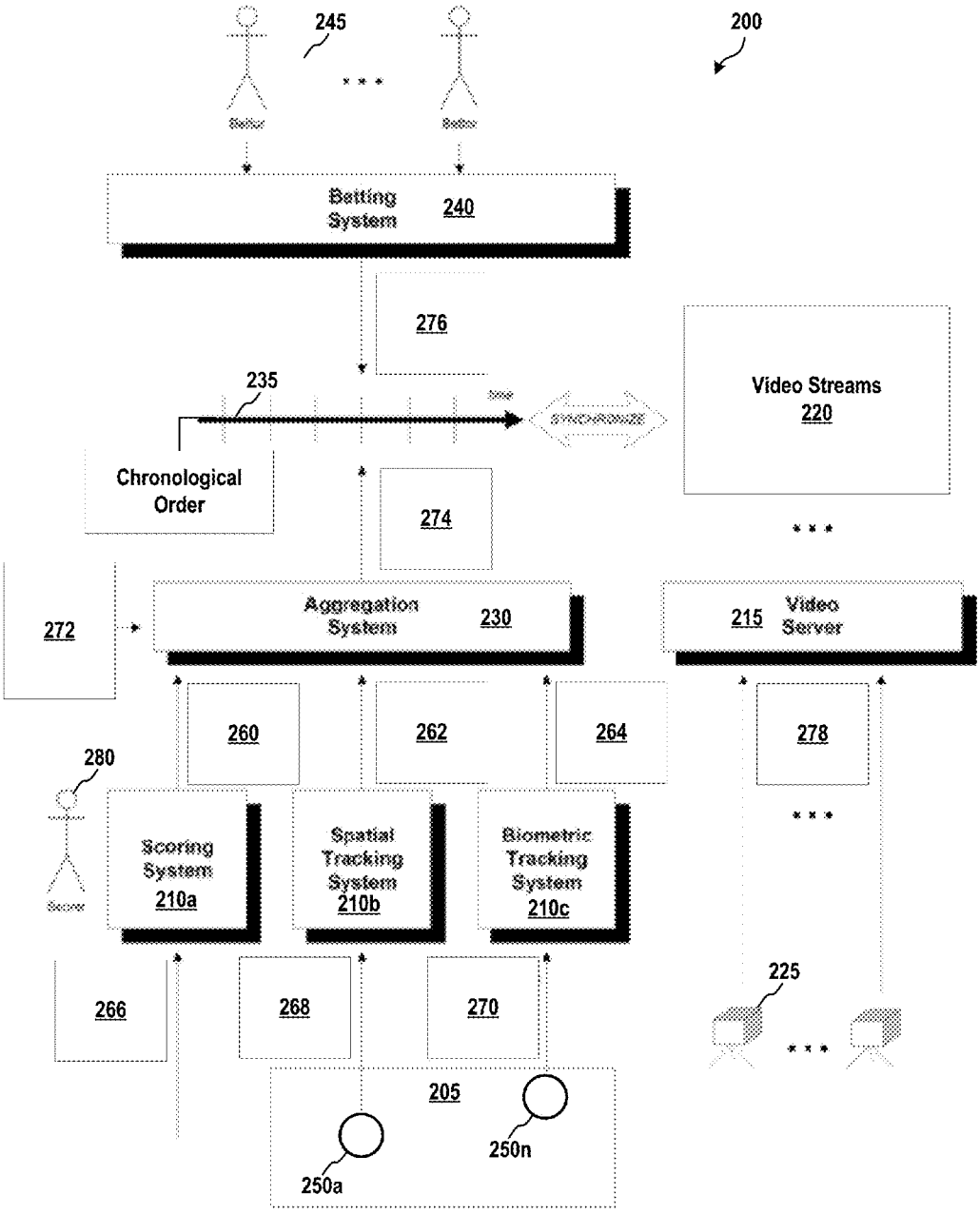
FIG. 2 depicts an illustrative in-play management system according to some embodiments.

FIG. 2 depicts an illustrative management system according to some embodiments. As shown in FIG. 2, the management system 200 may include event information systems 210*a-c* configured to generate event information from an event occurring at a competition area 205. In some embodiments, the event information systems 210*a-c* may be operated automatically and/or by an official scorer 280. In some embodiments, the management system 200 may be configured to execute a management application according to some embodiments. In some embodiments, as shown in FIG. 2, the management system 200 may be configured to provide a complete end-to-end solution for bookmakers to receive wagers from bettors.

A scoring system 210*a* may be configured to receive scoring information 266 and to provide various scoring data inputs, including team scores, time or game segment (for instance, inning, quarter, or period) information, manual play-by-play data, and automated scoring data 260. A spatial tracking system 210*b* may be configured to provide information associated with one or more participants 250*a-n* within the competition area 205, such as participant location, velocity, and/or direction 262. The spatial tracking system 210*b* may be used to track spatial data 268 including, without limitation, the location, velocity and direction of players, referees, the ball, and other physical landmarks via various sensors or other tracking technology including, without limitation global positioning satellite (GPS) devices, near field communication (NFC) devices, or the like. A biometric tracking system 210*c* may be configured to track various biometric data inputs 270 such as physiological and other biometric information of a participant 250*a-n*. The biometric data inputs 270 may include, without limitation, heart rate, blood pressure, or the like. The biometric tracking system 210*c* may be configured to provide biometric data 264 based on the biometric data inputs 270.

A media server 215, such as a video server, may be configured to receive media content 278 associated with the live event. In some embodiments, the video server 215 may receive video media content from multiple cameras 225. In some embodiments, at least a portion of the cameras 225 may be configured to capture a different view or angle of the live event action. In some embodiments, the video server 215 and/or the management application may be configured to generate various video streams 220 for use within the management system 200. In some embodiments, the video streams 220 may be customized based on various factors, such as user input, user preferences, event information, or the like. In some embodiments, at least a portion of the video accessed by the video server 215 may be obtained from third-party sources, such as national broadcast feeds. In some embodiments, at least a portion of the video accessed by the video server 215 may be obtained from video cameras operated, leased, accessed, or otherwise available to the management system 200. For instance, a competition area 205, such as a stadium, may provide access to video streams from cameras 225 arranged around the competition area. In another instance, the competition area 205 may allow an entity operating or associated with the management system 200 to install or otherwise operate cameras 225 located within the competition area.

The management system 200 may include an aggregation system 230 configured to aggregate information from the relevant information sources, including event information from the scoring system 210*a*, the spatial tracking system 210*b*, the biometric tracking system 210*c*, external data sources 272 (for instance, event and/or fan data, weather, social network content, and/or the like), and/or the like. The aggregation system 230 may be configured to aggregate the information and/or to perform calculations based on the information to generate event information 274, including sport-specific scoring and performance events for various live events simultaneously and in real time or substantially real time. The event information 274 may be synchronized with a corresponding video stream 220 to generate an event timeline 235 for each particular event.

A management system 240 may operate to present in-play opportunities (or "betting events") 276 to bettors 245 and to receive wagers for the in-play opportunities therefrom. In some embodiments, the management system 240 may be configured to receive and record wagers placed by the bettors 245. In some embodiments, the management system 240 may be configured to generate wager outcomes and to report them to the bettor 245 and/or the bookmaker associated with the wager. In some embodiments, a wager outcome may be reported to a bookmaker, and the bookmaker may review the event timeline 235 to confirm the wager outcome. The bookmaker may then approve the wager outcome for reporting and/or acknowledging to the bettor 245.

In some embodiments, the management system 240 may be configured to present the bettors 245 with the odds for each available in-play opportunity 276 wager. The management system 240 may be configured to implement the wagering gates according to some embodiments, including only allowing wagers to be placed prior to the actual time at which the corresponding scoring or performance-related event occurs.

In some embodiments, a monitor (or official) may be involved in the verification of event information 274 and/or wager outcomes. In some embodiments, in-play opportunities 276 and/or wagers placed thereon may be disabled, enabled, and/or canceled based on event information 274 and/or a review by the bookmaker and/or the monitor. In some embodiments, one or more bettors 245 may receive alerts, messages, or other communications indicating the status of an in-play opportunity 276. For instance, a bettor 245 accessing the system 200 through a mobile app may receive an alert that an in-play opportunity 276 has been enabled along with other corresponding information, such as the odds, the gate information, or the like. In some embodiments, the system 200 may be configured to determine which live events a bettor 245 is watching or is interested in and may enable and/or disable in-play opportunities 276 accordingly.

In some embodiments, disabling an in-play opportunity 276 means that no player may wager on the in-play opportunity. In some embodiments, the system 200 may be configured to enable in-play opportunities such that at least a portion of the bettors may wager on the in-play opportunity. In some embodiments, the in-play opportunity 276 may be selectively enabled for certain bettors 245, for example, based on groupings of the bettors, account status, historical activity, user preferences, which live events the bettor is watching, and/or the like. In some embodiments, the system 200 may allow for cancellation of any bettor's 245 wager, even after the corresponding scoring and performance-related event has occurred. In some embodiments, the result of cancellation may be that the bettor 245 may neither collect winnings nor lose money based on the outcome of that wager.

In some embodiments, enablement, disablement, and/or cancellation may be performed manually. For example, the decision process to enable, disable, or cancel any offered bet may include reviewing the event timeline and recorded video streams simultaneously and in a synchronous fashion. In some embodiments, enablement, disablement, and/or may be performed automatically based on information provided by the aggregation system 230 and/or the management system 240.

In some embodiments, the management system 240 may be configured to receive in-play opportunity suggestions from the bettors 245. In some embodiments, the system 200 may be configured to grant or deny the bettor-suggested in-play opportunities automatically based on past or current in-play opportunities (for instance, certain in-play opportunities may be generated by the system 200, but may not have been presented to the bettors 245) or by an administrator presented with the bettor-suggested in-play opportunity.

In some embodiments, the system 200 may be configured to include wager information on the event timeline 235. For example, the system 200 may provide a bookmaker with an event timeline 235 annotated with when and what type of wagers were placed by bettors 245 during the live event and/or the outcome thereof. In this manner, a bookmaker may be able to holistically examine the wagering activity during a live event. Such information may be used to provide and/or modify in-play opportunities in current and/or future live events.

Figure 3:
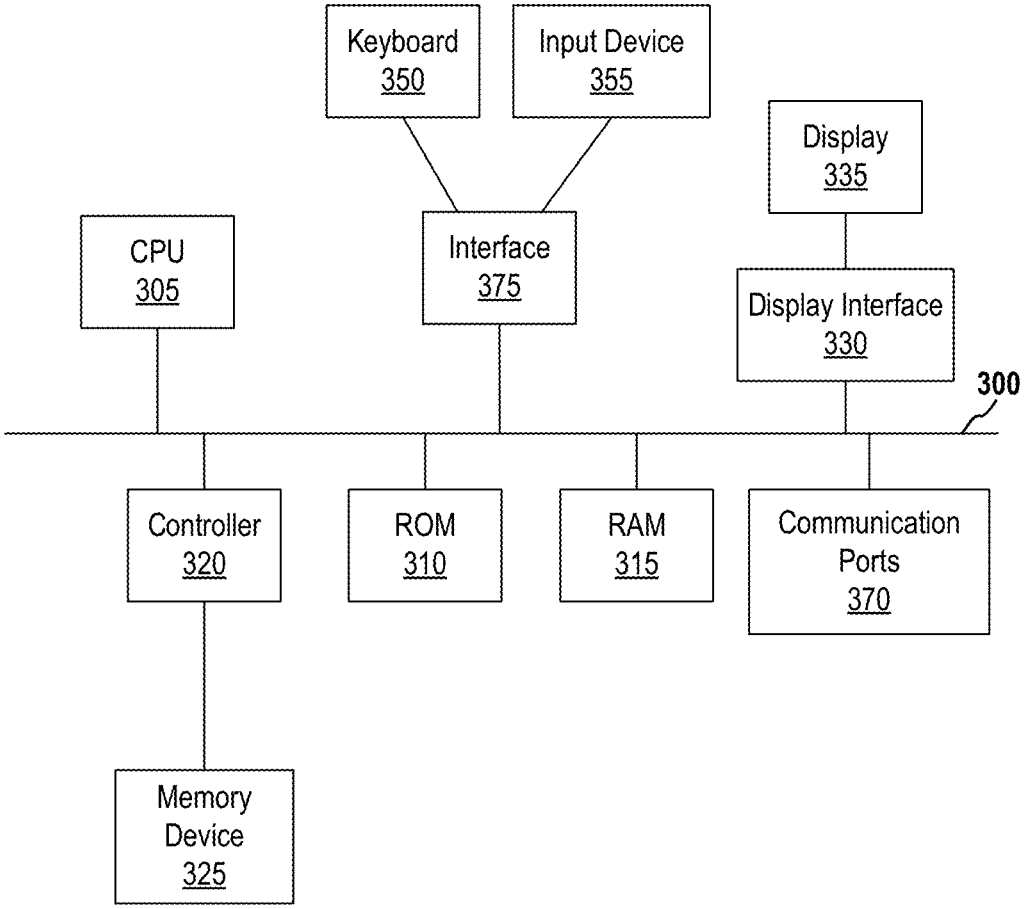
FIG. 3 illustrates various embodiments of a computing device for implementing the various methods and processes described herein.

FIG. 3 depicts a block diagram of exemplary internal hardware that may be used to contain or implement the various computer processes and systems as discussed above. A bus 300 serves as the main information highway interconnecting the other illustrated components of the hardware. CPU 305 is the central processing unit of the system, performing calculations and logic operations required to execute a program. CPU 305 is an exemplary processing device, computing device or processor as such terms are used within this disclosure. Read only memory (ROM) 310 and random access memory (RAM) 315 constitute exemplary memory devices.

A controller 320 interfaces with one or more optional memory devices 325 via the system bus 300. These memory devices 325 may include, for example, an external or internal DVD drive, a CD ROM drive, a hard drive, flash memory, a USB drive or the like. As indicated previously, these various drives and controllers are optional devices. Additionally, the memory devices 325 may be configured to include individual files for storing any software modules or instructions, auxiliary data, common files for storing groups of results or auxiliary, or one or more databases for storing the result information, auxiliary data, and related information as discussed above.

Program instructions, software or interactive modules for performing any of the functional steps associated with the determination, configuration, transmission, decoding, or the like of the presentation settings as described above may be stored in the ROM 310 and/or the RAM 315. Optionally, the program instructions may be stored on a tangible computer-readable medium such as a compact disk, a digital disk, flash memory, a memory card, a USB drive, an optical disc storage medium, such as a Blu-ray™ disc, and/or other recording medium.

An optional display interface 330 can permit information from the bus 300 to be displayed on the display 335 in audio, visual, graphic or alphanumeric format. Communication with external devices may occur using various communication ports 370. An exemplary communication port 370 may be attached to a communications network, such as the Internet or a local area network.

The hardware may also include an interface 375 which allows for receipt of data from input devices such as a keyboard 350 or other input device 355 such as a mouse, a joystick, a touch screen, a remote control, a pointing device, a video input device and/or an audio input device.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art, all language such as "up to," "at least," and the like include the number recited and refer to ranges which can be subsequently broken down into subranges as discussed above. Finally, as will be understood by one skilled in the art, a range includes each individual member. Thus, for example, a group having 1-3 elements refers to groups having 1, 2, or 3 elements. Similarly, a group having 1-5 elements refers to groups having 1, 2, 3, 4, or 5 elements, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A live event management system, comprising:

a computer server, the computer server including a processor and a non-transitory, computer-readable storage medium in operable communication with the processor;

at least one client computing device; and at least one device operable for spatial tracking;

wherein the at least one client computing device, the at least one device operable for spatial tracking, and the computer server are in real-time remote communication across an electronic network;

wherein the computer-readable storage medium contains one or more programming instructions that, when executed, cause the processor to:

receive live event information for a live event from at least one data source, the live event information including spatial tracking information of objects within a competition area from the at least one device operable for spatial tracking;

generate at least one event timeline based on the live event information, the at least one event timeline being configured to present at least one unit of live event information within the live event information in a chronological order;

generate at least one in-play opportunity for the live event based on the at least one event timeline;

gate wagering activity for the at least one in-play opportunity based on the live event information;

receive at least one wager from the at least one client computing device for the at least one in-play opportunity; and determine at least one wagering outcome of the at least one in-play opportunity based on the live event information.

2. The system of claim 1, further including at least one biometric tracking system operable for acquiring and tracking biometric information.

3. The system of claim 1, further including a mobile computing device in communication with a social network, the mobile computing device operable to receive live social networking and/or crowd-sourcing information from the social network and provide it to the processor for generating the at least one event timeline, for gating the wagering activity for the at least one in-play opportunity, and/or for determining the at least one wagering outcome of the at least one in-play opportunity.

4. The system of claim 1, further comprising at least one camera operably coupled to the processor, the at least one camera being configured to provide live event information comprising video media content, and wherein the computer-readable storage medium contains one or more programming instructions that, when executed, further cause the processor to analyze the video media content to determine the at least one unit of live event information.

5. The system of claim 1, wherein the at least one unit of live event information comprises at least one of a play, a score, a timing event, and an activity.

6. The system of claim 1, wherein the computer-readable storage medium contains one or more programming instructions that, when executed, further cause the processor to:

access video content of the live event, and generate information-synchronized media content by synchronizing the live event information with the video content.

7. The system of claim 1, wherein the computer-readable storage medium contains one or more programming instructions that, when executed, further cause the processor to disable the at least one in-play opportunity based on the live event information.

8. The system of claim 1, wherein the at least one client computing device is a mobile device in communication with the system through a mobile application on the mobile device.

9. The system of claim 1, wherein the at least one device operable for spatial tracking is a Global Positioning System (GPS) device or a near field communication (NFC) device.

10. The system of claim 1, further including a physiological tracking system operable to measure and transmit physiological information to the computer server and the computer server receiving physiological information from the device as live event information for generating the at least one event timeline, for gating the wagering activity, and/or for determining the at least one wagering outcome of the at least one in-play opportunity.

11. A computer-implemented method for managing live event information, the method comprising:

providing a computer server, the computer server including a processor and a non-transitory, computer-readable storage medium in operable communication with the processor;

providing at least one client computing device; and providing at least one device operable for spatial tracking;

wherein the at least one client computing device, the at least one device operable for spatial tracking, and the computer server are in real-time communication across an electronic network;

receiving live event information for a live event from at least one data source; the live event information including spatial tracking information of objects within a competition area from the at least one device operable for spatial tracking;

generating at least one event timeline based on the live event information, the at least one event timeline being configured to present at least one unit of live event information within the at least one event timeline in a chronological order;

generating at least one in-play opportunity for the live event based on the at least one event timeline;

gating wagering activity for the at least one in-play opportunity based on the live event information;

receiving at least one wager from the at least one client computing device for the at least one in-play opportunity; and determining at least one wagering outcome of the at least one in-play opportunity based on the live event information.

12. The method of claim 11, wherein the live event information comprises biometric information.

13. The method of claim 11, further including a mobile computing device in communication with a social network, the mobile computing device operable to receive live social networking and/or crowd-sourcing information from the social network and provide it to the processor for generating the at least one event timeline, for gating the wagering activity for the at least one in-play opportunity, and/or for determining the at least one wagering outcome of the at least one in-play opportunity.

14. The method of claim 11, further comprising receiving video media content as live event information from at least one camera operably coupled to the processor, and further including the step of analyzing the video media content to determine the at least one unit of live event information.

15. The method of claim 11, wherein the at least one unit of live event information comprises at least one of a play, a score, a timing event, and an activity.

16. The method of claim 11, further comprising:

accessing video content of the live event, and generating information-synchronized media content by synchronizing the live event information with the video content.

17. The method of claim 11, further comprising disabling the at least one in-play opportunity based on the live event information.

18. The method of claim 11, further including receiving at least one in-play wagering opportunity suggestion from the at least one client computing device.

19. The method of claim 11, wherein the spatial tracking device is a Global Positioning System (GPS) device or a near field communication (NFC) device.

20. The method of claim 11, further including a physiological tracking system measuring and transmitting physiological information and the processor receiving the physiological information from the device.

* * * * *